US009332785B2

(12) United States Patent
Hoffmann

(10) Patent No.: US 9,332,785 B2
(45) Date of Patent: May 10, 2016

(54) METHOD OF MANUFACTURING MULTI-SEGMENT FILTER RODS

(75) Inventor: Hans-Reiner Hoffmann, Grevenbroich (DE)

(73) Assignee: INT'L TOBACCO MACHINERY POLAND SP. ZO.O, Radom (PL)

( * ) Notice: Subject to any disclaimer, the term of this patent is extended or adjusted under 35 U.S.C. 154(b) by 597 days.

(21) Appl. No.: 13/812,002

(22) PCT Filed: Aug. 10, 2011

(86) PCT No.: PCT/PL2011/000087

§ 371 (c)(1), (2), (4) Date: Jan. 24, 2013

(87) PCT Pub. No.: WO2012/021078

PCT Pub. Date: Feb. 16, 2012

(65) Prior Publication Data

US 2013/0123085 A1 May 16, 2013

(30) Foreign Application Priority Data

Aug. 13, 2010 (PL) ..... 392134

(51) Int. Cl.
*A24D 3/02* (2006.01)

(52) U.S. Cl.
CPC ..... *A24D 3/0295* (2013.01); *A24D 3/0287* (2013.01)

(58) Field of Classification Search
CPC ..... A24D 3/0295; A24D 3/0287; A24C 5/34; A24C 5/3418; A24C 5/20; A24C 5/31; B31B 19/74; B31B 2219/95; B31B 1/16; B31B 1/74; B31B 2201/95; B26D 7/2635
See application file for complete search history.

(56) References Cited

U.S. PATENT DOCUMENTS 4,503,868 A * 3/1985 Coyte ..... 131/282
4,604,083 A * 8/1986 Barny et al. ..... 493/34

(Continued)

FOREIGN PATENT DOCUMENTS

EP 1 913 824 A1 4/2008
EP 1 913 825 A1 4/2008

(Continued)

OTHER PUBLICATIONS

International Search Report for PCT/PL2011/000087, mailing date of Nov. 23, 2011.

(Continued)

*Primary Examiner* — Sameh Tawfik
(74) *Attorney, Agent, or Firm* — Westerman, Hattori, Daniels & Adrian, LLP

(57) ABSTRACT

After the start of manufacturing, the control system provisionally calculates a cutting moment necessary to obtain a proper length of the filter rod and compares it with the basic static relationship calculated earlier, after which it makes a gradual adjustment of the cutting moment in relation to the calculated basic static relationship and determines an averaged cutting point of a filter roller considering the information about actual dimensions of the segments and their actual positioning in the roller, conveyed by a sensor. During manufacturing, the averaged cutting point is compared by the control system with the cutting moment and, in order to keep the length tolerance of the filter rod, dynamically corrected considering the information about the segments currently conveyed by the sensor.

5 Claims, 1 Drawing Sheet

(56) References Cited

U.S. PATENT DOCUMENTS

| | | | | |
|---|---|---|---|---|
| 4,724,429 | A * | 2/1988 | Millen et al. | 340/679 |
| 4,737,904 | A * | 4/1988 | Ominato | 700/58 |
| 4,967,739 | A * | 11/1990 | Wochnowski | 131/84.1 |
| 5,044,379 | A * | 9/1991 | Cahill et al. | 131/280 |
| 5,284,164 | A * | 2/1994 | Andrews et al. | 131/280 |
| 5,466,209 | A * | 11/1995 | Takegawa et al. | 493/4 |
| 6,234,943 | B1 * | 5/2001 | Copin | 493/11 |
| 2001/0001390 | A1 | 5/2001 | Smith et al. | |
| 2003/0062054 | A1 * | 4/2003 | Dall'Osso et al. | 131/83.1 |
| 2007/0144542 | A1 * | 6/2007 | Bencivenni et al. | 131/58 |
| 2009/0252440 | A1 * | 10/2009 | Biese et al. | 383/37 |

FOREIGN PATENT DOCUMENTS

| | | | |
|---|---|---|---|
| GB | 854470 | A | 11/1960 |
| WO | 2006/000918 | A2 | 1/2006 |

OTHER PUBLICATIONS

Written Opinion of the International Search Authority for PCT/PL2011/000087, mailing date of Nov. 23, 2011.

* cited by examiner

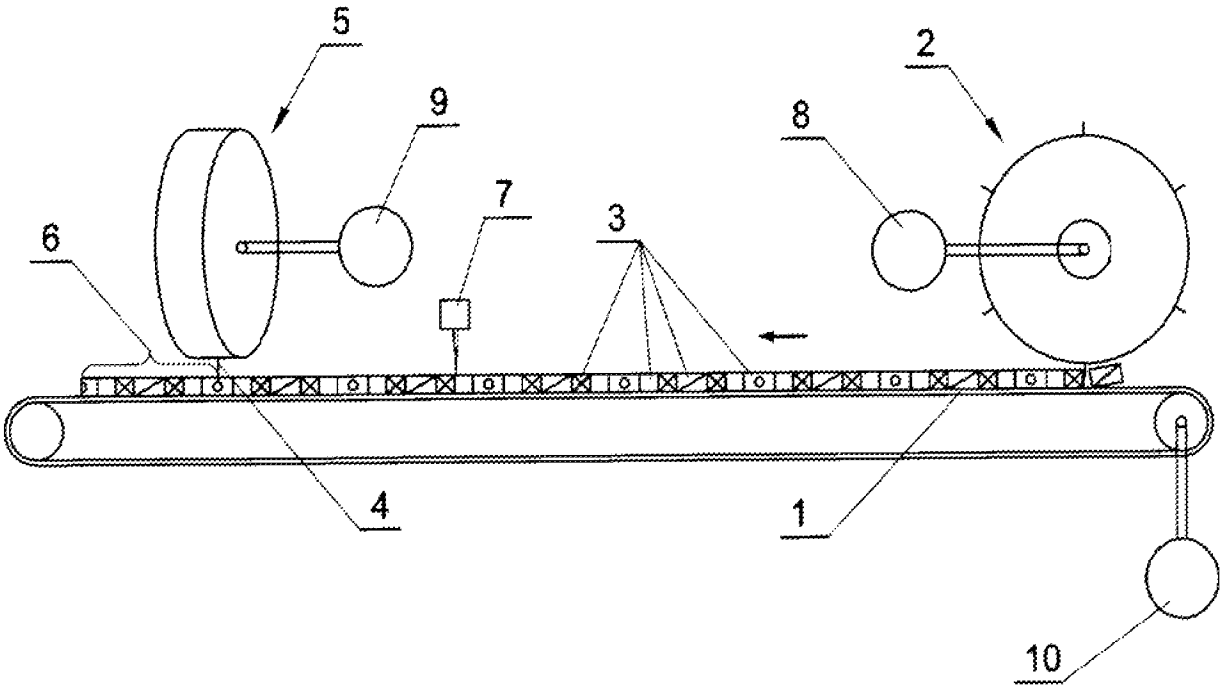
2
8
3
7
9
5
6
1
4
10

METHOD OF MANUFACTURING MULTI-SEGMENT FILTER RODS

The object of the invention is a method of manufacturing multi-segment filter rods for cigarettes using automatic control of rod length repeatability.

BACKGROUND OF THE INVENTION

In the tobacco industry, there is a demand for multi-segment filters used for the manufacture of cigarettes which are composed of at least two kinds of segments made of different materials, such segments may be soft, filled for example with unwoven cloth, paper, cellulose acetate, or hard, filled with granulate or sintered elements, or hollow cylinders. A sequence of elements formed on a grouping tape is conveyed onto a format tape where it is wrapped into a paper wrapper, and a formed roller is appropriately divided into filter rods by means of a cutting head, where cutting takes place in the middle of a longer segment. In the course of further production operations, obtained rods are stuck on cigarettes directly or after repeated cutting, also in the middle of a longer segment. It is known that the length of particular filter segments and their arrangement in the roller may change within allowable tolerance, where the length tolerance of a filter rod is adjusted to the final constant length of manufactured cigarettes. With a considerable movement speed of the roller, reaching 500 m/min., cutting moment control is necessary in order to keep the length of the filter rod considering said tolerances, where the filter rods are monitored continuously. From the description of the British patent No. GB 854.470, a method of mechanical selection of the cutting moment of a filter roller composed of two different filter segments in order to obtain filter rods of equal length is known. An apparatus for this purpose has one common driving motor which by means of a multitude of gears activates particular units closely mechanically linked with each other and dependent on the system controlling a common drive. An acceleration or a delay of the cutting moment in order that the filter segments are always cut in the middle, forming filter rods with equal length in keeping with the tolerance, is made possible by a differential gear installed in the power transmission system between a drum feeding segments onto the format tape and a cutting head. Another method of adjusting the cutting moment of cigarette roller elements, consisting of filter segments and a tobacco rod, in order to obtain filter cigarettes with a certain length in keeping with allowable tolerance was presented in the patent application description of the USA invention No. US 2001/0001390. Filter segments and tobacco rods, which are provisionally placed onto the paper wrapper by means of a worm drum, are conveyed further towards the formatting element, where wrapping of paper wrapper takes place. At the same time, in the area of the formatting element the position of segments and rods is recorded by means of a unit creating their image, consisting of a stroboscope and a display, from which obtained image is sent to the computer. There, the recorded image is compared with a reference image entered earlier into the memory of the computer. Depending on the results of the comparison, shifting of the cutting head along the wall parallel to the cigarette roller is possible. In case of exceeding the allowable tolerance, cut cigarettes are rejected. In addition, the invention shows schematically an apparatus for controlling and cutting a roller into finished products or rejection of defective products. In modern machines of the tobacco industry, in particular for the production of cigarettes and/or filters, a separate servomotor is used for the drive of each unit of a machine, whereas all servomotors are coupled by a common virtual electronic shaft connected with the control system. Solutions regarding the control of the roller cutting point presented in the known state of the art cannot be applied to such modern machines.

SUMMARY OF THE INVENTION

According to the invention, a method of manufacturing multi-segment filter rods used in the tobacco industry for cigarettes, where various segments arranged in an appropriate order on a grouping tape are conveyed by means of a feeding unit onto a format tape, on which they are wrapped into a paper wrapper forming a filter roller, and then are divided into filter rods with a certain length by means of a cutting head, and the position of each segment in the roller on the format tape is checked by means of a sensor situated between the feeding unit and the cutting head, where the feeding unit, the cutting head and the format head are driven by separate servomotors coupled by a common virtual electronic shaft connected with the control system, consists in that, before the start of manufacturing, information regarding the segment to be cut, the length of the filter rod, the order of segments in a rod and the constant distance between the feeding unit and the cutting head is entered into the control system, after which the control system calculates the basic static electronic relationship between drive systems of the servomotors of the feeding unit and the cutting head, considering the drive system of the servomotor of the format tape. After the start of manufacturing, the control system provisionally calculates the cutting moment necessary to obtain a proper length of the filter rod and compares it with the basic static relationship calculated earlier, after which it makes a gradual adjustment of the cutting moment in relation to the calculated basic static relationship and determines the averaged cutting point of the filter roller, considering the information about actual dimensions of segments and their actual positioning in the roller, conveyed by the sensor. In the course of manufacturing multi-segment filter rods, the averaged cutting point is compared by the control system with the cutting moment and, in order to keep the tolerance of the filter rod, dynamically corrected taking into account the information about the segments currently conveyed by the sensor. The control of the cutting moment and the correction of the averaged cutting point take place by adjusting electronic drive systems of the servomotors of the feeding unit and the cutting head, with a constant position of the cutting head. In case of a change of the length of manufactured filter rods, the cutting head is adjusted. The use of the method according to the invention allows reducing the time necessary for the adjustment of the machine to a new length of the filter rod which has been limited to the time necessary for averaging the measurements and changing the cutting moment of the cutting head so as to adjust the cutting moment to the expected point. In addition, the material loss has been limited only to the period of operation of the machine from the moment of start to the adjustment of the cutting moment of the filter rod.

BRIEF DESCRIPTION OF THE DRAWINGS

FIG. 1 shows, in schematic view, a fragment of a machine for manufacturing multi-segment filter rods.

DETAILED DESCRIPTION OF THE INVENTION

The drawing presents a fragment of a machine showing a format tape 1 onto which by means of a feeding unit 2 various segments 3 arranged earlier in an appropriate order on a not shown grouping tape are conveyed. On the format tape 1, the segments 3 are wrapped into a paper wrapper and sealed, forming a filter roller which is cut by a cutter 4 of a cutting head 5 into equal filter rods 6 with double length, where cutting takes place in the middle of a longer segment 3. The filter rods 6 prepared in such a way are conveyed for further processing in order to obtain a filter with a certain length which is subsequently joined to a tobacco rod so that a cigarette is formed. In the area of the format tape 1, between the feeding unit 2 and the cutting head 5, a sensor 7 checking the position and the parameters of the segments 3 in a roller is situated, with the distance between the feeding unit 2 and the cutting head 5 being constant. The feeding unit 2 is driven by a servomotor 8, the cutting head 5 is driven by a servomotor 9, and the format tape 1 is driven by a servomotor 10, where all servomotors 8, 9, 10 are coupled by a common virtual electronic shaft, connected with the general control system of the machine, not shown in the drawing. In case of a change of specification of the filter rod 6 caused for example by a change of one of the segments 3 or the sequence of arrangement of the segments 3 in the rod 6, which involves a change of the length of manufactured rod 6, the machine is switched off and the cutting head 5 is regulated by adjusting it to a new length of the rod 6, and the information regarding the segment 3 to be cut, the length of the filter rod 6, the sequence of segments 3 in the rod 6 is entered, while keeping a constant distance between the feeding unit 2 and the cutting head 5, after which the control system calculates a basic static electronic relationship between the drive system of the servomotor 8 of the feeding unit 2 and the drive system of the servomotor 9 of the cutting head 5, considering the drive system of the servomotor 10 of the format tape 1. After the start of the machine, corrective manufacturing takes place during which the control system provisionally calculates a cutting moment in order to obtain a proper length of the filter rod 6 and compares it with the basic static relationship calculated earlier, after which it makes a gradual adjustment of the cutting moment to the calculated basic relationship, and an averaged cutting point of the filter roller, considering the information about actual dimensions of the segments 3 and their actual positioning in the roller, conveyed by the sensor 7, is determined. The control of the cutting moment and the correction of the averaged cutting point take place by adjusting electronic drive systems of the servomotor 8 of the feeding unit 2 and the servomotor 9 of the cutting head 5 with its constant position and constant distance between the feeding unit 2 and the cutting head 5, where the correction of the cutting point is made by accelerating or delaying the cutting moment of the cutting head 5. Filter rods 6 manufactured during corrective manufacture are rejected as defective products, but this stage of operation of the machine is very short. In the course of the process of manufacturing filter rods 6, the averaged cutting point is constantly compared by the control system with the cutting moment determined after the adjustment and, in order to keep the length tolerance of the rod 6, is dynamically corrected considering the information about the segments 3 currently conveyed by the sensor 7.

The invention claimed is:

1. A method of manufacturing multi-segment filter rods used in the tobacco industry for cigarettes, comprising:

conveying a plurality of segments with a feeding unit, onto a format tape, wrapping the plurality of segments on the format tape in a paper wrapper to form a filter roller, dividing the filter roller into a plurality of filter rods with a cutting head which cuts the plurality of segments within the filter roller, each filter rod thereby containing a plurality of segment halves, entering information regarding the segments to be cut, a length of the filter rods, a sequence of segments in the filter rod and filter roller, and a constant distance between the feeding unit and a cutting head into a control system, calculating a basic static electronic relationship between drive systems of servomotors of the feeding unit and the cutting head, considering a drive system of a servomotor of the format tape, checking the position of each segment on the format tape by a sensor disposed between the feeding unit and the cutting head, provisionally calculating a cutting moment necessary to obtain the length of the filter rod, in the control system, comparing the provisionally calculated cutting moment with the basic static electronic relationship, in the control system, gradually adjusting the cutting moment in relation to the calculated basic static electronic relationship, and determining an averaged cutting point of the segments based on information about actual dimensions of the segments and actual positioning of the segments in the filter roller, obtained from the sensor, wherein the feeding unit, the cutting head and the format tape are driven by separate servomotors coupled by a common, virtual electronic shaft connected with the control system.

2. The method as in claim 1, wherein, the control system compares the averaged cutting point with the cutting moment, and wherein the averaged cutting point is dynamically corrected based on the information obtained from the sensor about the segments currently conveyed, in order to keep a length tolerance of the filter rod.

3. The method as in claim 2, wherein control of the cutting moment and correction of the averaged cutting point are performed by adjustment of electronic drive systems of the servomotors of the feeding unit and the cutting head, with a constant position of the cutting head.

4. The method as in claim 1, wherein control of the cutting moment and correction of the averaged cutting point are performed by adjustment of electronic drive systems of the servomotors of the feeding unit and the cutting head, with a constant position of the cutting head.

5. The method as in claim 1, wherein the cutting head is adjustable in order to change the length of the filter rods.

* * * * *